United States Patent [19]

Bick et al.

[11] Patent Number: 4,893,291

[45] Date of Patent: Jan. 9, 1990

[54] DEVICES FOR AIDING RESYNCHRONIZATION OF BODY CLOCKS

[75] Inventors: Peter A. Bick, Fife; Christine J. Kinnell, Edinburgh, both of Scotland

[73] Assignee: Jet-R Limited, Edinburgh, Scotland

[21] Appl. No.: 236,970

[22] Filed: Aug. 26, 1988

[30] Foreign Application Priority Data

Aug. 29, 1988 [GB] United Kingdom ..... 8720477

[51] Int. Cl.[4] ..... G04B 47/00; G04B 19/22

[52] U.S. Cl. ..... 368/10; 368/21; 368/82; 368/223

[58] Field of Search ..... 368/10, 28–30, 368/76, 77, 82, 223–228, 233, 234, 21–24

[56] References Cited

U.S. PATENT DOCUMENTS 4,151,831 5/1979 Lester ..... 368/10

4,540,153 12/1980 Merritt ..... 368/28

*Primary Examiner*—Vit W. Miska

[57] ABSTRACT

A device for aiding resynchronization of a personal body clock of a traveller, said device comprising a first data series representing the personal body time of the traveller and a second data series representing a local time at the destination of the traveller. Both said data series include representations of twenty-four hours and are displaceable with respect to each other. The mutual displacement of the data series is carried out with reference to the time of the departure of the traveller and the duration of the journey of the traveller to give a readable display of a procedure to resynchronize the personal body clock of the traveller, the procedure comprising controlling exposure of the body of the traveller to daylight.

Certain embodiments of the device are electronic, and are in the form of a calculator or in the form of a program for a calculator or for a wrist watch.

15 Claims, 7 Drawing Sheets

FIG. 3
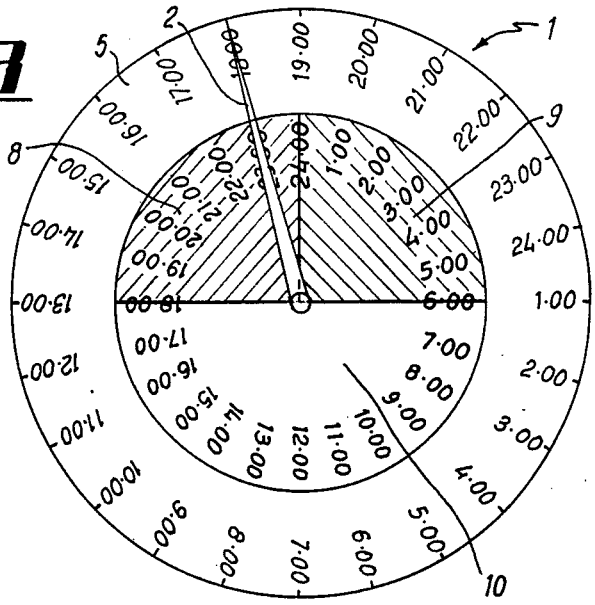
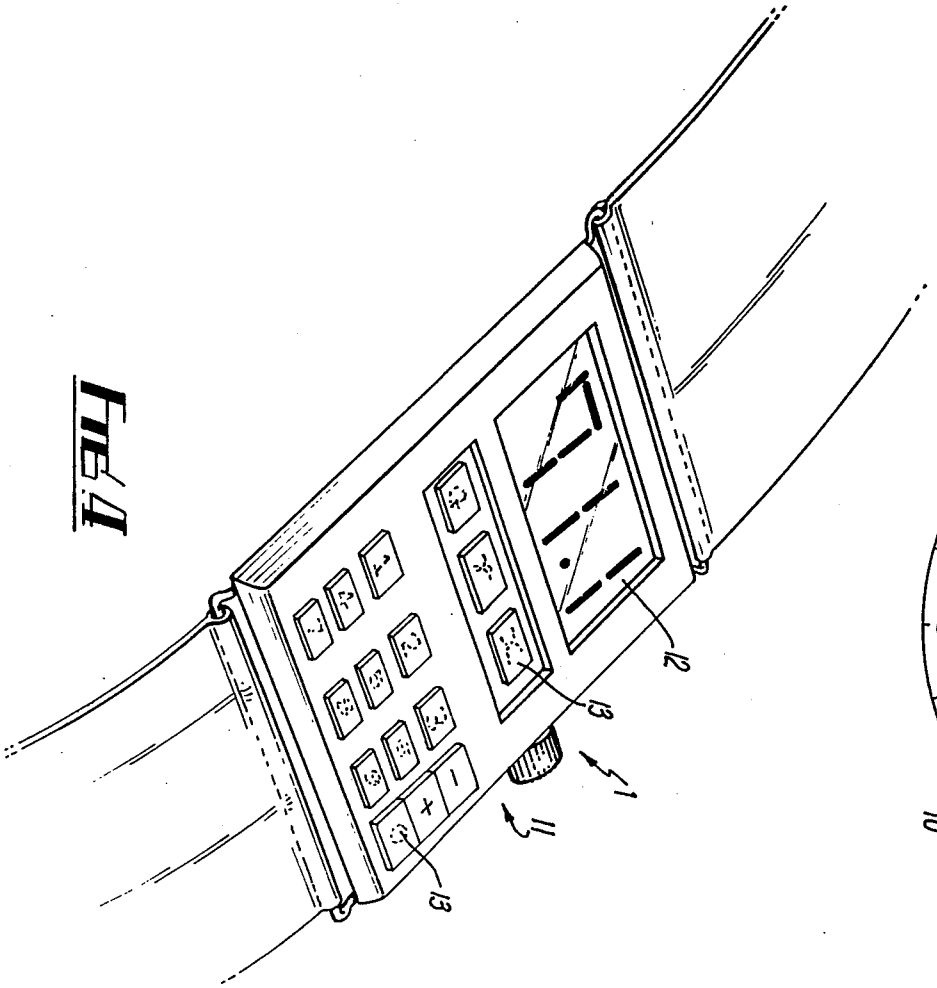
FIG. 4

LCD
3:1MUX
G127
BP1
BP2
BP3
S0
S1
S2
S30
S31
8576
L.C.D. DRIVER
IC2
BPO.
Vdd
SCL
SDA
OSC.
A0 A1 A2 SA0 VLCD VSS
R7
TR1
R8
TR2
R9
R5
R6
HC 18/C Package
6MHZ
R4
C6
C5
C3
C4
D3
D2
D1
+5V.
8749μP
IC1
P10
P20
RESET
EA
DB0
DB1
DB2
INT
T0
Xtal
X1
C7
R3
R2
R1
VDD
G134
G132
78L05
G171
C8
JSKT
G170
SET MINS.
S1
SET HRS.
S2
ENTER
S3

DEVICES FOR AIDING RESYNCHRONIZATION OF BODY CLOCKS

This invention relates to devices for aiding resynchronisation of body clocks, and more particularly but not exclusively to devices for assisting the re-normalisation of the biorhythms of travellers who have completed relatively long journeys including substantial longitudinal displacement (i.e., nett movement to East or West.)

This invention has particular application for individuals who undertake rapid flights across terrestial time zones and have onerous business schedules that fail to allow for aclimatisation periods to recover from jet-lag, the effects of which include tiredness, depression, insomnia and inability to function with intellectual efficiency.

Jet-lag is caused by desynchronisation of personal circadian rhythms ("body clocks"). Circadian rhythms control a range of activities, including general metabolism, and patterns of sleep and intellectual concentration. These "body clocks" are set automatically to local time and conditions by reference to the duration of daylight. When a traveller crosses time zones, desynchronisation of the personal circadian rhythm results as the personal cues of dawn and dusk fail to occur at the biologically expected time.

It is therefore an object of the present invention to provide a device for aiding a traveller to obviate or mitigate the de-normalisation of biorhythms due to substantial longitudinal displacement.

According to the present invention there is provided a device for aiding resynchronisation of a personal body clock of a traveller, said device comprising a first data series representing the personal body time of the traveller and a second data series representing local time at the destination of the traveller, both said data series having representations of twenty-four hours and being displaceable with respect to each other, the mutual displacement of the data series being carried out with reference to the time of the departure of the traveller and the duration of the journey of the traveller to give a readable display of a procedure to resynchronise the personal body clock of the traveller, said procedure comprising controlling exposure of the body of the traveller to daylight.

Each said data series is preferably cyclic, and the displacement of one data series with respect to the other data series is preferably accomplished by relative phase displacement.

The device may be electronic and may be in the form of a calculator or in the form of a program for a calculator or for a wrist watch, or the device may be entirely manually operable.

Preferably, the representations of twenty-four hours on each data series will be in the form of a 24-hour clock.

Preferably, there will be electronic means or manual means for aligning the representations of the 24 hour-clocks of the first data series and of the second data series.

Preferably, the data series representing the personal body time of the traveller comprises representation of behavioural actions associated with the twenty-four hour representations, said association being on a principle of delay or of advancement of the personal body clock by selected behavioural actions comprising controlling exposure of the traveller's body to daylight.

Preferably, in the electronic form of the device, said association will be retained and the organising and aligning will be effected by a program and circuitry with the readable display as a liquid crystal digital display.

In the manually operable form of the device, the data series may each be in the form of a relatively slidable scale; the organising of the scales may be effected by moving one scale relative to the second scale, the scales being associated in the form of a slide rule or as two manually rotatable concentric discs or dials of different diameters.

Preferably, the aligning means in the manually operable form of the device is a pointer or hand.

Preferably, for the manually operable form of the device, the scale representing the traveller's body time displays readable codes for guidance on the procedure for resynchronising the traveller's body clock.

Preferably, each device is accompanied by an explanatory leaflet.

Embodiments of the present invention will now be described, by way of example, by reference to the accompanying drawings, in which:

FIGS. 1 to 3 are plan views of three settings of one embodiment of a device according to the present invention for aiding resynchronisation of a traveller's body clock;

FIG. 4 is a second embodiment of a device according to the present invention for aiding resynchronisation of a traveller's body clock;

Figure 1:
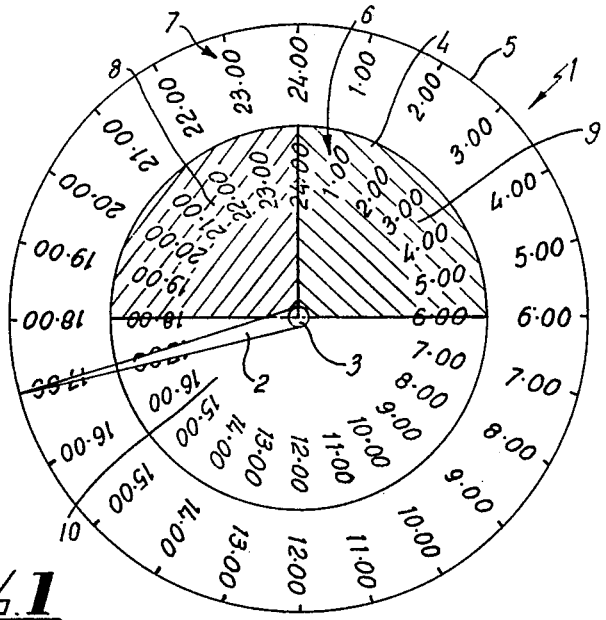

Referring to the drawings, there are shown devices for aiding resynchronisation of a traveller's body clock, the devices functioning on the axiom that exposure to daylight during the period 18.00 to 24.00 hours body time delays the body clock, whereas exposure to daylight during the period 24.00 to 6.00 hours body time advances the body clock.

Figure 2:
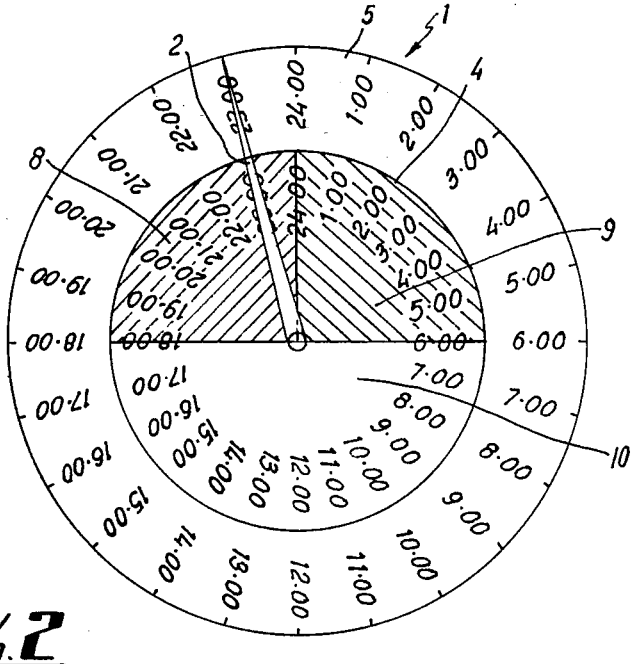

Referring especially to FIGS. 1 to 3 of the drawings, the device 1 comprises a pointer 2 attached by a central rivet 3 to the common centre of two concentric dials 4, and 5. The upper dial 4, of smaller diameter, shows a 24 hour clock scale 6 of the traveller's body time. The lower dial 5, of larger diameter than the upper dial 4, shows a 24 hour clock scale 7 of time at the place of the traveller's destination. The upper dial 4 is additionally provided with colour shaded zones 8 and 9. On the dial 4, a red zone 8 encompasses the period 18.00 to 24.00 hours body time, which is the period for delaying a body clock, and a green zone 9 encompasses the period 24.00 to 6.00 hours body time, which is the period for advancing a body clock.

In use, the pointer 2 is first placed on the hour of the scale 6 of the upper dial 4 that represents the hour of the traveller's departure (FIG.1). The pointer 2 is advanced by the number of hours spent travelling (FIG. 2) and then the upper dial 4 and pointer 2 together are aligned with the traveller's arrival time in local hours represented on the hour scale 7 of the lower dial 5 (FIG.3). When travelling West, the body clock is delayed by exposure to daylight during the times on the lower scale 7 opposite the red zone 8 of the upper dial 4. During the ensuing six-hour period opposite the green zone 9, daylight should be avoided. Conversely, when travelling East, the body clock is advanced by light exposure during the times on the lower scale 7 opposite the green zone 9, and by avoiding daylight during the times on the lower scale 7 opposite the red zone 8. If crossing over more than twelve time zones, whether travelling East or West, the traveller's body requires to be exposed to daylight during the times shown on the lower scale 7 opposite the red zone 8 and requires to avoid daylight during the times opposite the green zone 9; this procedure should then be repeated for the next two days, providing that the traveller remains in the place of destination.

Ideally, the full number of hours exposure to daylight and avoidance of sunlight should be observed. Further, as this is not always convenient, the greater the number of hours of exposure or of avoidance at the appropriate time, the more successful is the mitigation of jet-lag. No special measures are necessary during the period on the lower scale 7 opposite an unshaded zone 10 of the upper dial 4. By manipulating exposure to daylight, the body clock is reset; there is always enough light available for resynchronisation, even during heavy rain. The crucial factor is during the day after a journey, when the body should be exposed to or concealed from daylight. The present invention helps jet-setting business people to know quickly and easily the best times for such exposure or avoidance and thus to resynchronise their body clocks and avoid jet-lag.

Referring especially to FIG. 4 of the drawings, the device 1 is in the form of a program in an electronic watch 11 which is battery operated with a liquid crystal digital display 12. Calculator-like buttons 13 are used to enter the information required: namely the hour of departure, the number of hours spent travelling and the arrival time. The data series in the program will be organised and aligned, and a subsequent read-out will give instructions on when to conceal or to expose the body to sunlight. The readout may be self-explanatory or it may require reference to an associated leaflet.

A specific application of the invention will now be described, with reference to the following example and FIGS. 1 to 3 of the accompanying drawings.

EXAMPLE

Travelling from London to New York, the device 1 is first set with the pointer 2 to the departure time of 17.00 hrs body time, that is the 17.00 hours mark on the inner scale 6 (FIG.1). The flight normally takes six hours and thus the pointer 2 is advanced by six hours (FIG.2). However, New York is five hours behind London and arrival time in the place of destination is 18.00 hours local time. Hence, the pointer 2 and the upper dial 4 are moved together to be aligned with the arrival time of 18.00 hours as represented on the lower dial 5 (FIG.3). However the traveller's body clock assumes it to be 17.00 hours plus the six hour flight, that is 23.00 hours, and the clock therefore needs to be delayed (the flight having been westward). The device 1 indicates that the body requires an hours evening walk between 18.00 and 19.00 hours and the avoidance of daylight from then until nightfall. The hour walk will trick the body into believing it to be still dusk and not yet time for sleep, while concealment from daylight after 19.00 hours local time will prevent the body clock being advanced and thus avoid creating further disruption to the individual's system.

Figure 5:
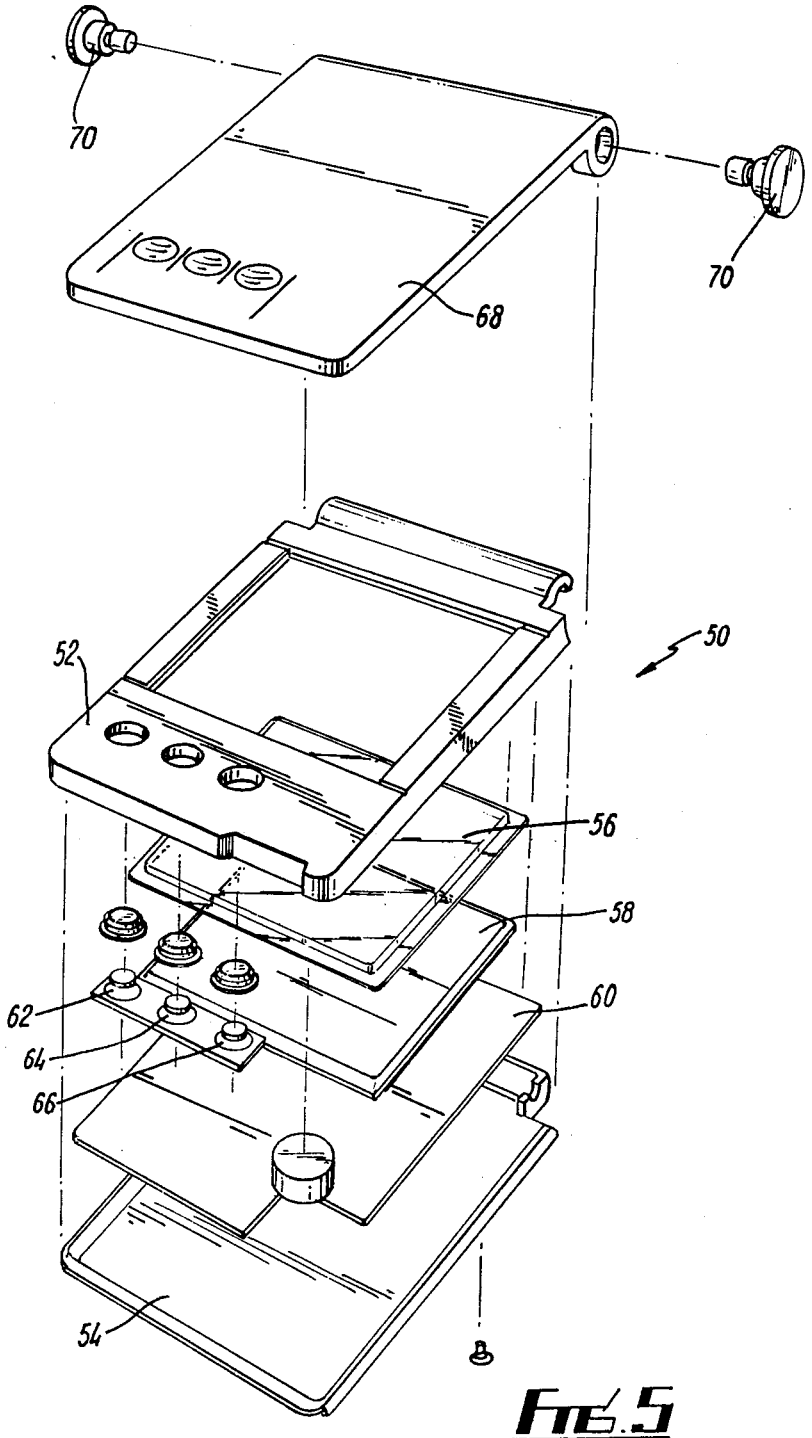
FIG. 5 is an exploded perspective view of an electronic pocket model of the device.

Referring now to FIG. 5, this shows an exploded perspective view of an electronic model of the invention which is particularly designed to be carried in the pocket of a traveller. As shown in FIG. 5, the device 50 comprises a front cover 52 and a back cover 54. The covers 52 and 54 are clamped together round their edges in the fully assembled configuration of the device 50. The front cover 52 has a large acrylic window 56 through which a liquid crystal digital display 58 indicates relevant information. The display 58 is suitably driven by electronic circuitry mounted on an underlying printed circuit board 60. Setting of the appropriate timings is performed by three controls 62, 64 and 66 in a manner analogous to that described with respect to FIGS. 1, 2 and 3, with respective control knobs protruding through apertures in the front cover 52.

A protective cover 68, of the same size as the front cover 52, is hinged by pivots 70 to the top edge of the device 50 so that the cover 68 can be folded down over the window 56 and the controls 62, 64 and 66 to protect these while the device is being carried in a pocket or handbag. The protective cover 68 can be hinged upwards when the device 50 is to be consulted and/or have its timings adjusted.

Figure 6:
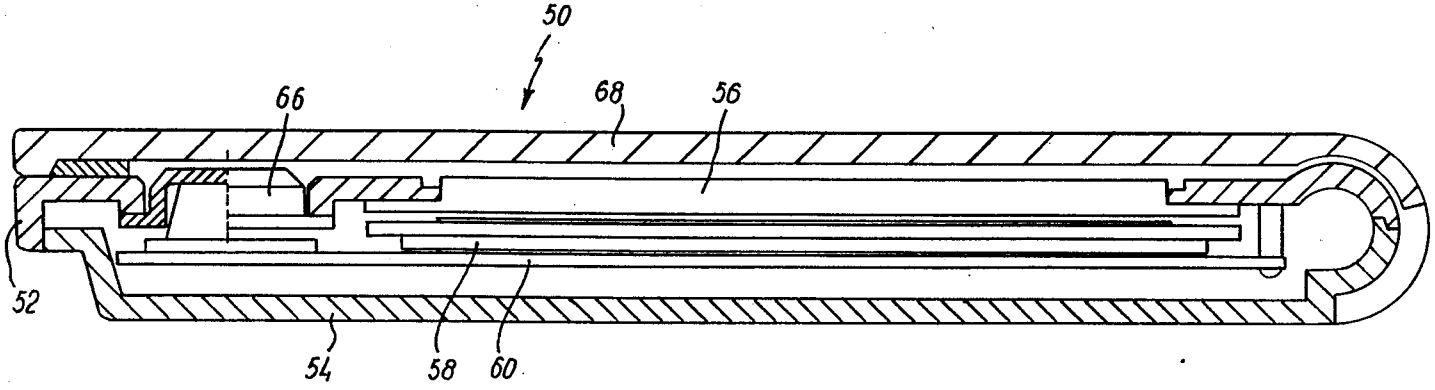
FIG. 6 is a longitudinal vertical cross-section of the device of FIG. 5 in its assembled condition.

FIG. 6 shows a longitudinal vertical mid-line section of the device 50 of FIG. 5 in its fully assembled configuration, and with the protective cover 68 in its closed position. FIG. 6 particularly illustrates the compact sandwich of components producing a relatively thin assembly well suited to being carried in a suit pocket.

Figure 7:
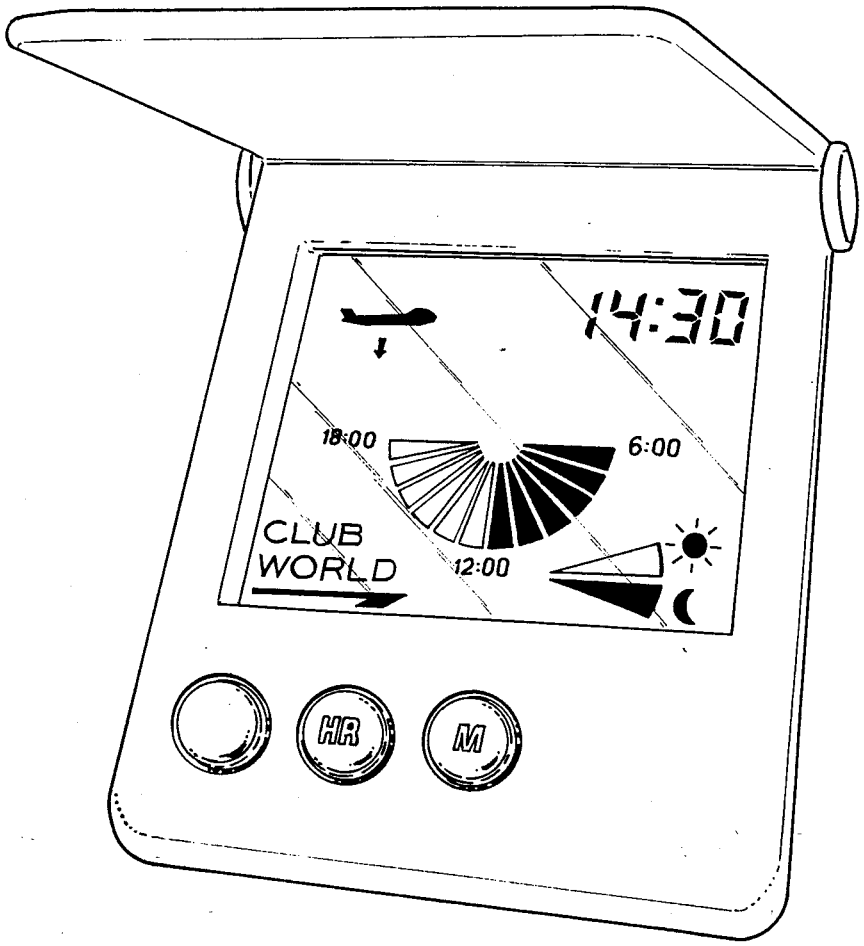
FIG. 7 is a perspective view of the display face of a digital pocket model of the device.

A modified form of pocket digital device is shown in FIG. 7, and its operation will now be described. (As shown in FIG. 7, a hinged protective lid is open to reveal the information display).

DESCRIPTION OF OPERATION

The display of the modified digital device is as shown in FIG. 7, with modifications to the 24-hour clock outline and sectors to allow for connecting tracks. A clock symbol should be added to signify the mode when local time is being entered.

The control keys can be reduced to two - MODE ("M") and SET ("HR") - such that no slide-switch should be necessary; (the third button is shown in FIG. 7 as a redundant non-functioning blank).

Assuming that the device was last used some time ago, and is now time-expired from the previous session:

(i) Reset and Local Time Entry

The user holds down both keys (MODE and SET) simultaneously for at least 2 seconds. This causes the device to reset. The LCD displays a clock face symbol and the four numeric digits show the currently set local time in 24-hour form. The two hours digits are flashing. If any change in the hours is necessary, then single short presses of the SET key will advance the hours by one. (The hour display increments when the SET key is released). If the SET key is held down for more than 2 seconds the hours start to increment automatically at a rate of about 2 per second. Whenever the hours are correct (and no adjustment may have been necessry), the MODE key is pressed and the device now causes the two minutes digits to flash. If any adjustment is necessary, the SET key is used as for the hours, and when the minutes are correct the MODE key is again pressed to enter:

(ii) Departure Time Entry

An aircraft symbol is on the screen and the DOWN arrow is flashing. In this mode the user is being requested to enter the time of departure in local time. The numeric display is showing local time, and the two hours digits are flashing. Pressing SET advances the hours by one for each press. (The hour display increments occur when the SET key is released).

Holding the set key down for more than one (1) second causes the arrows to advance automatically at about two (2) per second.

When the correct hour of departure is set up on the LCD, the user presses the MODE key to advance to setting the minutes in the departure time.

The two minutes digits on the LCD will not be flashing, and pressing the SET key as above sets up the correct minutes. When this has been done, the user presses MODE to take the device to:

(iii) Entry of Flight Duration

The DOWN arrow disappears and is replaced by two inward facing arrows which flash on either side of the aircraft symbol utilised to denote that flight duration is currently being set. The numeric display will be showing the previous flight duration with the hours digits flashing. The SET key is used to advance the hours to the hours of flight duration (by single step or auto-advance). Only hours have to be entered in this mode, and therefore when the hours are correct the user presses MODE to enter:

(iv) Entry of Arrival Time

The inwards pointing arrows (directed at the aircraft symbol) disappear to be replaced by a flashing downwards pointing arrow. The numeric display shows the previous arrival time, with the two hours digits flashing. The hours of arrival in new local time are entered on the display using the SET key as before. The MODE key is pressed and the minutes are entered by means of the SET key. Pressing the MODE key when the minutes are correct then enters:

(v) Entry of Flight Direction

Pressing the SET keys toggles the direction arrows from westwards to eastwards to westwards et seq. When the correct direction is displayed, the user presses the MODE key, which causes the device to enter:

(vi) Display of Time Sectors

The display clears to show the outline (not a complete circle) of the 24-hour clock and its surrounding numerals. The required light and dark sectors are not displayed immediately, but the display first shows the light sector advancing through a complete revolution and then settling at the correct position on its second revolution. The dark sector is then positioned by a similar process taking more than one revolution. A "key" showing a sun next to a light segment and a moon next to a dark segment is displayed at one corner of the LCD.

When the sectors have stabilised, the numeric display shows a 24-hour representation of local departure zone time.

The sector display remains on the LCD until the time (in new local time) arrives when the first hour of "treatment" has passed. This first "treatment" segment then disappears. As time advances, the "treatment" segments disappear in turn at hourly intervals. (This is to ensure that the user does not follow outdated advice).

When all the sectors have timed out, and been eradicated, an "EXPIRED" symbol could optionally be displayed.

The LCD continues to show the local departure zone time.

Pressing MODE and SET simultaneously for more than 2 seconds will at any time reset the device to the start of the setting sequence. Since the setting steps now start from the previously entered values, a reset allows the user to scan through his settings for verification, or to correct a wrong entry with minimum key presses.

Figure 8:
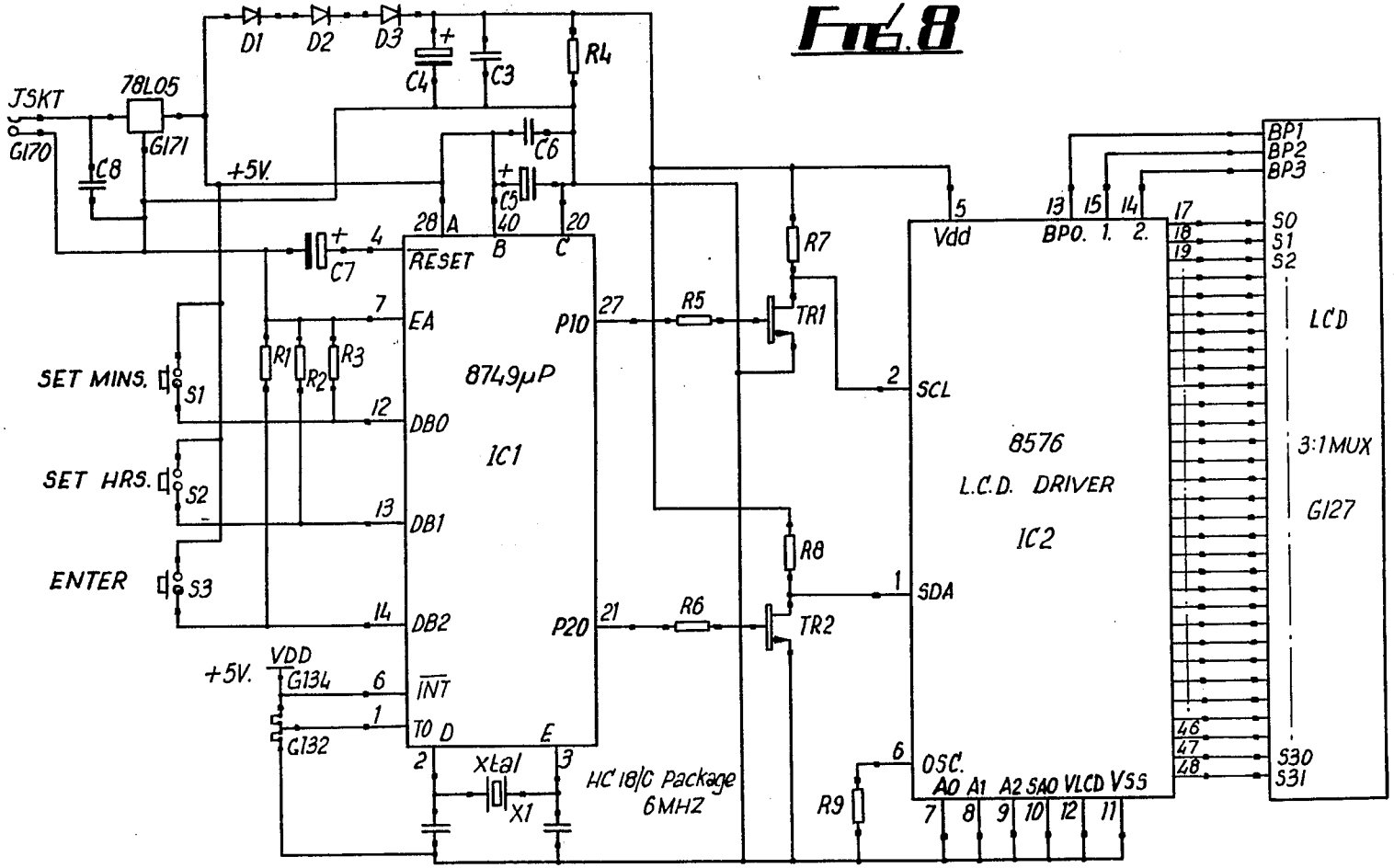
FIG. 8 is a schematic electronic circuit diagram of a prototype electronic system for performing the invention.

The circuit described below with reference to FIG. 8 is a prototype built in limited numbers, and therefore economics do not justify a custom-built circuit; however the functional capabilities are equivalent to a mass-produced customised circuit. Therefore it is not necessary to go to the length of using a low-power single-chip microcontroller specially manufactured for this prototype. The hardware of the prototype will therefore not take full advantage of integration on silicon, and will be of greater extent than the production version. In addition, the battery will be external tot he case of the device, and will have a life of about 2 to 3 operating hours.

The hardware of the prototype circuit consists of two large integrated circuits, an LCD (liquid crystal display) and several discrete components. The integrated circuits consist of an 8749 EPROM device, and an LCD driver chip.

The microcontroller is an 8749 EPROM device which has 2k of EPROM, 128 bytes of RAM, 27 I/O lines and a timer counter. The I/O lines handle the 3 switch inputs, the CLUB WORLD enabling line and 2 output lines for driving the I-C bus for the LCD driver chip.

The 8749 has a 6 MHZ crystal which gives an instruction cycle time of 2.5 microseconds, and instructions take one or two cycles.

The 5 volt supply for the 8749 is derived from the 9 volt battery supply via a 78LO5 5 volt regulator. The 3 volt supply for the LCD driver chip and the LCD has to supply a very low current and is therefore very simply provided by 3 diode drops from the 5 volt rail. The LCD is a 3 volt device because the production device will be driven from 3 volts, and therefore the prototype LCD and its driver are driven from 3 volts.

The 8576 LCD driver chip is driven via its I-C bus and requires a voltage converter from the 5 volt signals from the 8749. Two transistors provide this function, and also provide isolation of the SDA line to allow the 8576 chip to drive this line LOW when it acknowledges data transfers. (See 8576 data sheet). Pins 7, 8 and 9 of the 8576 are held low, giving the chip the address of O. The prototype configures the 8576 to operate in 3 way multiplexing mode, and 3 back-plane pins are used as well as 39 segment pins. (There are 40 segment lines available.)

The LCD is a custom device with 42 pins.

Current consumption is a little below 100 mA.

The circuit software program is written in 8749 assembler and was developed on a SALDEP48 development system which is based on a BBC microcomputer. It occupies about 1300 bytes and about 70 bytes of RAM are used.

There are three main sections:

(1) keyswitch handling and decoding;

(2) display driver; and
(3) time-zone calculation.

In addition, the on-chip timer interrupt is heavily used to time various operations such as key debounce, segment flashing and display rotation rate.

The program sequence is traced by a MODE variable which ranges from 0 to 9 as follows:

MODE 0 - all previous data cleared, enter departure time;
MODE 1 - enter flight time;
MODE 2 - enter arrival time;
MODE 3 - enter EAST/WEST;
MODE 4 - calculate segment moves;
MODE 5 - launch 7 light segments;
MODE 6 - rotate 7 light segments;
MODE 7 - launch 6 dark segments;
MODE 8 - rotate 6 dark segments; and
MODE 9 - continue to display the light and dark segments and wait for RESET.

The transitions between the early MODES occur when the ENTER key is pressed, and the subsequent MODE changes occur automatically upon completion of the current task. The device ends up in MODE 9 awaiting a RESET.

The keyswitch handler has a software debounce time of 40 ms. If the MINS or HOURS key is held down for longer than 1.5 seconds, the MINS or HOURS display digits increment at about 8 per second.

The display driver has to generate by software the serial signals to drive the I-C bus. The communications are in 8 bit sections, the first 4 being control bytes and the remaining 13 are data bytes. For every display update, no matter how little is being changed,t he complete message of 17 bytes is sent.

Because the segment layout for the radial segments is not homogeneous, rotating this zone of the display is not as simple as it might have been. Instead of one subroutine to shift the 3 LCD segments driven by each 8576 segment pin, there are several to cope with the different ordering of the LCD segments on the segment lines.

The time-zone calculation calculates as follows:

(1) Time-zones equals departure hours plus flight hours minus arrival hours (refined to take account of minutes (departure minutes plus flight minutes minus arrival minutes) and rounded to nearest hour).
(2) Time zones should be positive for WEST and negative for EAST; make so by adding or subtracting 24, to take care of passing through 0.00 o'clock.
(3) If EAST check for 12 or more time zones.
(4) Calculate segment rotations to take up correct position on LCD.
(5) Add one extra revolution to give extra "life" to the display.

The display is then produced by:

(1) feeding in 7 light segments at the midnight position;
(2) further rotation of these 7 segments by more than one complete revolution till they take up their final position;
(3) feeding in 6 dark segments at the midnight position; and
(4) further rotation of these 6 segments by more than one complete revolution till they take up their final position.

The device then pauses, displaying the 24-hour clock segments, until the user resets the device by holding down the hours and minutes key.

Figure 9:
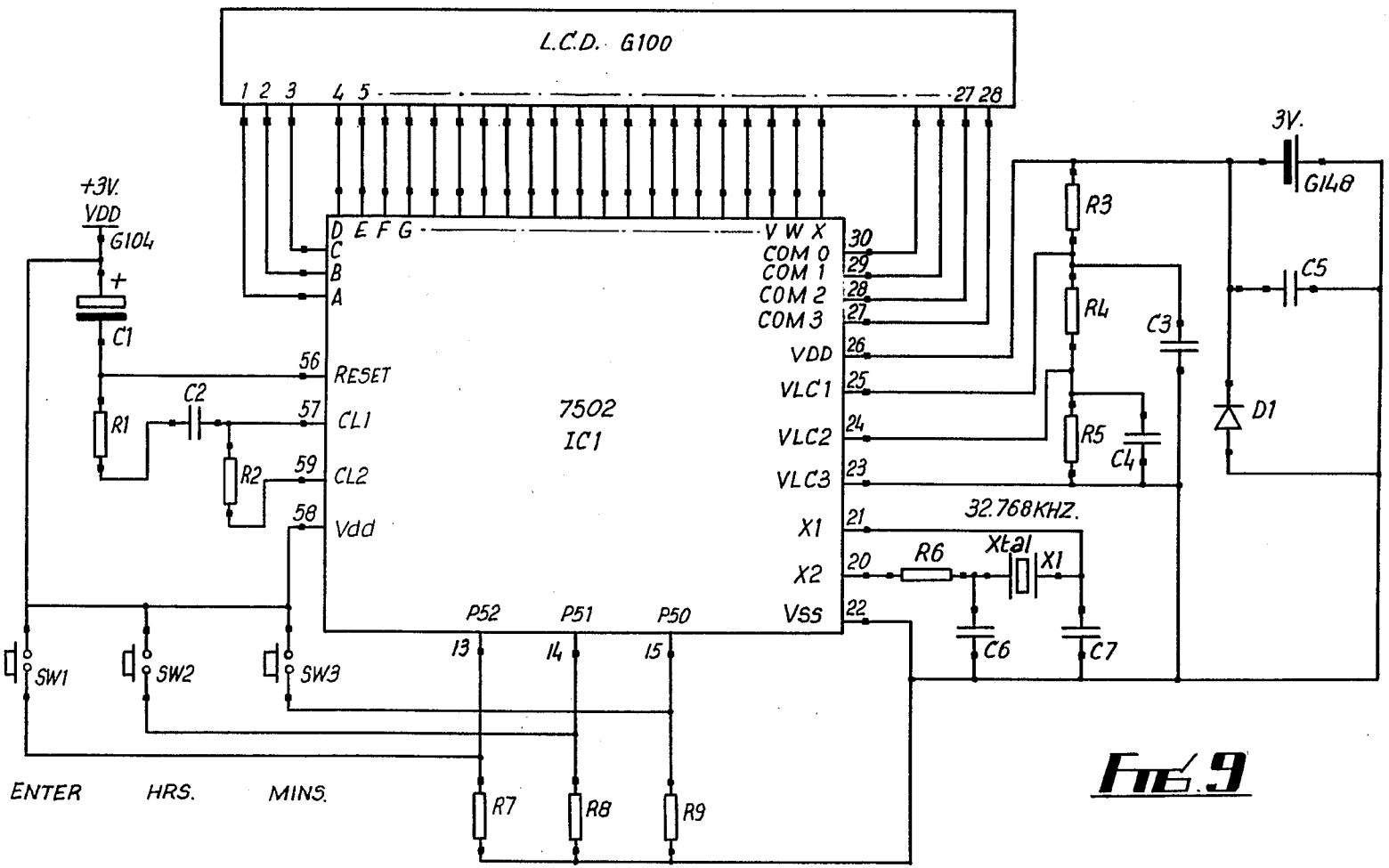
FIG. 9 is a schematic electronic circuit diagram of a production electronic system for performing the invention.

Having described the prototype circuit of FIG. 8, FIG. 9 shows a similar electronic circuit which performs the same general functions, but is more specifically adapted to use on a large scale (i.e. mass-production) and is constructed accordingly.

Modifications and variations other than those described above can be adopted without departing from the scope of the invention.

We claim:

1. A device for aiding resynchronization of a personal body clock of a traveller, said device comprising a first data series representing the personal body time of the traveller and a second data series representing local time at the destination of the traveller, both said data series having representations of twenty-four hours and being displaceable with respect to each other, the mutual displacement of the data series being carried out with reference to the time of the departure of the traveller and the duration of the journey of the traveller, a readable display for indicating a procedure to resynchronise the personal body clock of the traveller upon said mutual displacement, said procedure comprising controlling exposure of the body of the traveller to daylight.

2. A device as claimed in claim 1 wherein each said data series is cyclic, and the displacement of one data series with respect to the other data series is accomplished by relative phase displacement.

3. A device as claimed in claim 1 wherein the device is electronic, and is in the form of a program for a calculator.

4. A device as claimed in claim 3 wherein the program is incorporated in a calculator, and said calculator is embodied as a wrist-mounted instrumentality.

5. A device as claimed in claim 1, wherein the representation of twenty-four hours on each data series is in the form of a respective 24-hour clock on each data series.

6. A device as claimed in claim 5 including aligning means for aligning the representations of the 24-hour clocks of the first data series and of the second data series.

7. A device as claimed in claim 6 wherein the data series representing the personal body time of the traveller comprises representation of behavioural actions associated with the twenty-four hour representations.

8. A device as claimed in claim 6 wherein the device includes aligning means for aligning the representations of the first and second data series and is realised by means of electronic circuitry, said association is retained in a program and the mutual displacement and aligning is effected by said program and circuitry with the readable display as a visible digital display.

9. A device as claimed in claim 8 wherein said visible digital display is a liquid crystal digital display.

10. A device as claimed in claim 1 wherein the device is a manually operable form of device,t he data series each being in the form of a relatively slidable scale, the displacement of the scales being effected by moving one scale relative to the second scale, the scales being associated in the form of two mutually rotatable concentric discs of different diameters.

11. A device as claimed in claim 10 wherein the device includes aligning means comprising a pointer independently rotatable over said concentric discs.

12. A device as claimed in claim 10 wherein the scale representing the traveller's body time displays readable codes for guidance on the procedure of resynchronising the traveller's body clock.

13. A method of aiding resynchronisation of a personal body clock of a traveller to assist the re-normalisation of the biorhythm of the traveller when said traveller has completed a relatively long journey including substantial longitudinal displacement, said method comprising the steps of calculating the journey time, amending said journey time to coincide with the arrival time at the journey destination according to local time at the destination, and calculating the difference in exposure to daylight at the destination to prevent the traveller's body clock being altered while at said destination.

14. A method as claimed in claim 13 as applied to a traveller completing a relatively long journey West, comprising the steps of setting journey departure time to the actual local time at the point of departure which is also the traveller's natural body time, adding the journey time to the departure time to provide a calculated arrival time in terms of the departure time zone, retarding the calculated arrival time by the amount appropriate to Westward travel through progressively retarding time zones, and undertaking a re-normalisation procedure involving a schedule of exposure and avoidance of daylight.

15. A method as claimed in claim 13 as applied to a traveller completing a relatively long journey East, comprising the steps of setting journey departure time to the actual local time at the point of departure which is also the traveller's natural body time, adding the journey time to the departure time to provide a calculated arrival time in terms of the departure time zone, advancing the calculated arrival time by the amount appropriate to Eastward travel through progressively advancing time zones, and undertaking a re-normalisation procedure involving a schedule of exposure and avoidance of daylight.

* * * * *